United States Patent [19]

Cole

[11] 4,046,654

[45] Sept. 6, 1977

[54] PROCESS FOR DESALINATION WITH CHLOR-ALKALI PRODUCTION IN A MERCURY DIAPHRAGM CELL

[76] Inventor: Marc Cole, 1057 C Argyll Circle, Lakewood, N.J. 08701

[21] Appl. No.: 674,288

[22] Filed: Apr. 6, 1976

[51] Int. Cl.[2] ..... C25B 1/26; C25B 1/20; C25B 13/08; C25B 1/02

[52] U.S. Cl. ..... 204/99; 204/98; 204/128; 204/129; 204/149; 204/180 R; 204/290 R; 204/294; 204/296

[58] Field of Search ..... 204/98, 99, 128, 129, 204/251, 149, 296, 180 R, 290 R, 294

[56] References Cited

U.S. PATENT DOCUMENTS

| | | | |
|---|---|---|---|
| 1,109,311 | 9/1914 | Allen | 204/251 |
| 3,242,059 | 3/1966 | Cottam et al. | 204/98 |
| 3,775,272 | 11/1973 | Danna | 204/98 |

OTHER PUBLICATIONS

"Development of Electrochemical Ion Exchange Materials & Techniques for Desalting Water" U.S. Dept. of Interior, Office of Saline Water, R & D Progress Report No. 300, Jan. 1968, by A. W. Venolia et al.

"The Electrosorb Process for Desalting Water" U.S. Dept. of Interior, Office of Saline Water, R & D Progress Report No. 516, Mar. 1970, by A. M. Johnson et al.

*Primary Examiner*—R. L. Andrews

[57] ABSTRACT

Desalination process associated with chlor-alkali production in an electrolytic cell having a diaphragm structure comprising an immobilized liquid alkali metal amalgam.

17 Claims, 8 Drawing Figures

PROCESS FOR DESALINATION WITH CHLOR-ALKALI PRODUCTION IN A MERCURY DIAPHRAGM CELL

This invention relates to an electrolyzing process for concomitant production of desalinated water, a halogen gas, hydrogen, and an alkali metal hydroxide of high concentration containing substantially no alkali halides. More particularly, a concentrated akali metal hydroxide solution and desalinated water is produced by electrolyzing sea water using an improved diaphragm cell in which an immobilized liquid alkali metal amalgam is used as a cationic conductor between the anode and cathode compartments of said cell.

There is no known art for concomitant production of desalinated water and chlor-alkali by sea water electrolysis for the reason that as ion concentration decreases with sea water electrolysis power costs become prohibitive, in cells so far devised.

It has been found that with an immobilized amalgam diaphragm the distance between an anode and said diaphragm can be drastically reduced and that with the aid of a cationic exchanger in said reduced brine gap and the aid of turbulent flow of anolyte thru said gap power requirements are reduced to competitive levels.

British Pat. No. 16,048 of Oct. 23, 1913 discloses a mercury containing porous diaphragm. However, the contained mercury is contaminated with oxidizing agents, and neither alkali metal hydroxide nor desalinated water are produced in this cell.

Use is made of oxygen or air to depolarize the cathode in the cell of the present invention, and this use reduces cell voltage and thus reduces power requirements per ton of product.

U.S. Pat. No. 3,775,272 discloses an electrolytic chlor-alkali cell featuring an immobilized liquid alkali metal amalgam diaphragm structure completely enclosed by cation permeable diaphragms. To date the only cation permeable membrane, of the efficient polymers mentioned in the above patent, is a perfluoroaliphaticsulfonic acid membrane which is too expensive for use herein. Mention is also made in the above patent of microporous inert metals, as the enclosing diaphragms. Of other polymeric membranes mentioned, lifetimes of said membrane in aqueous chlorine are low except at low concentrations of chlorine, and a microporous metal whose pores are filled with an anolyte of low ion concentration has very poor ionic conductivity. Hence the enclosing diaphragms of the above cited patent are of limited use herein.

Figures 1, 2:
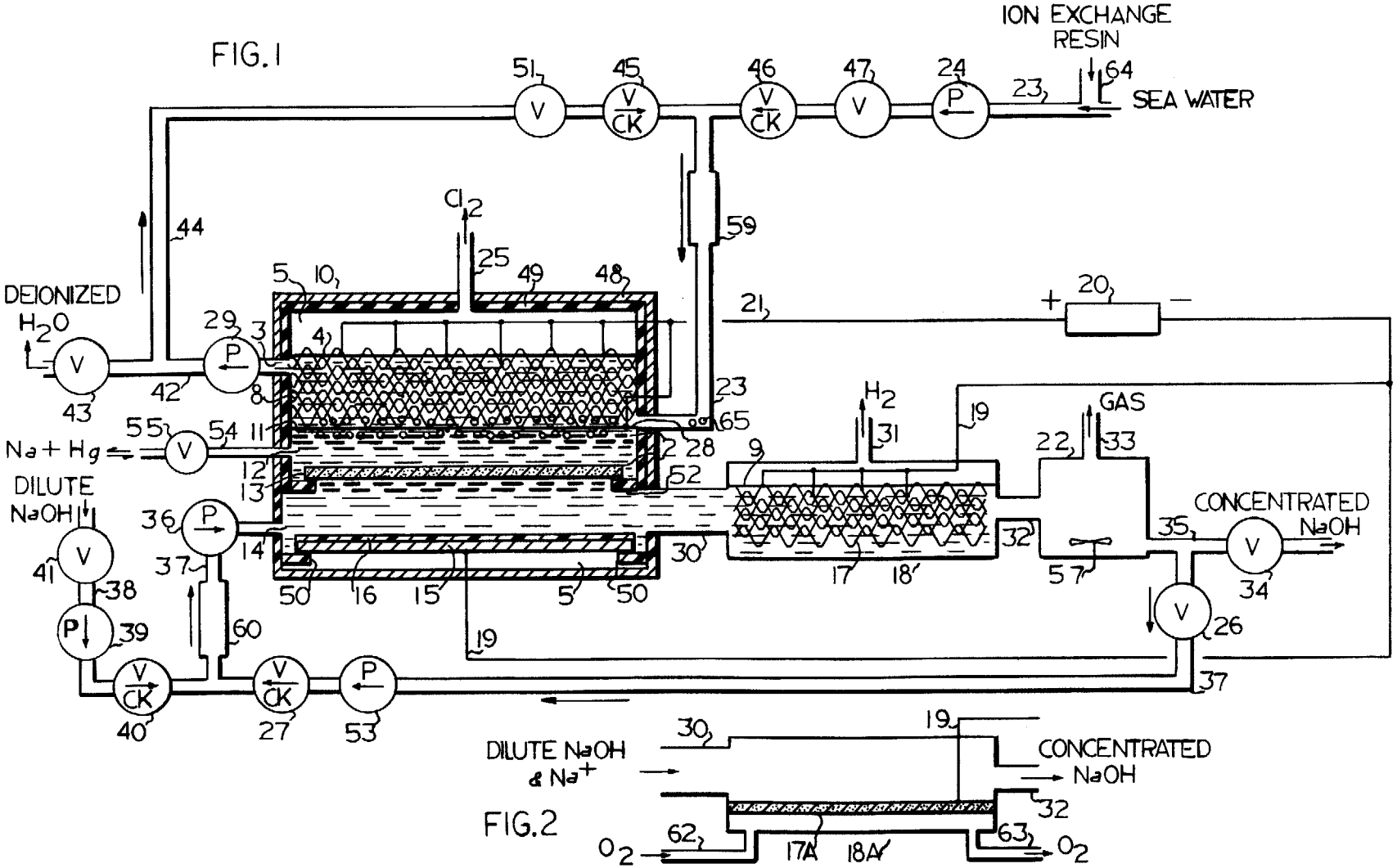
Figure 3:
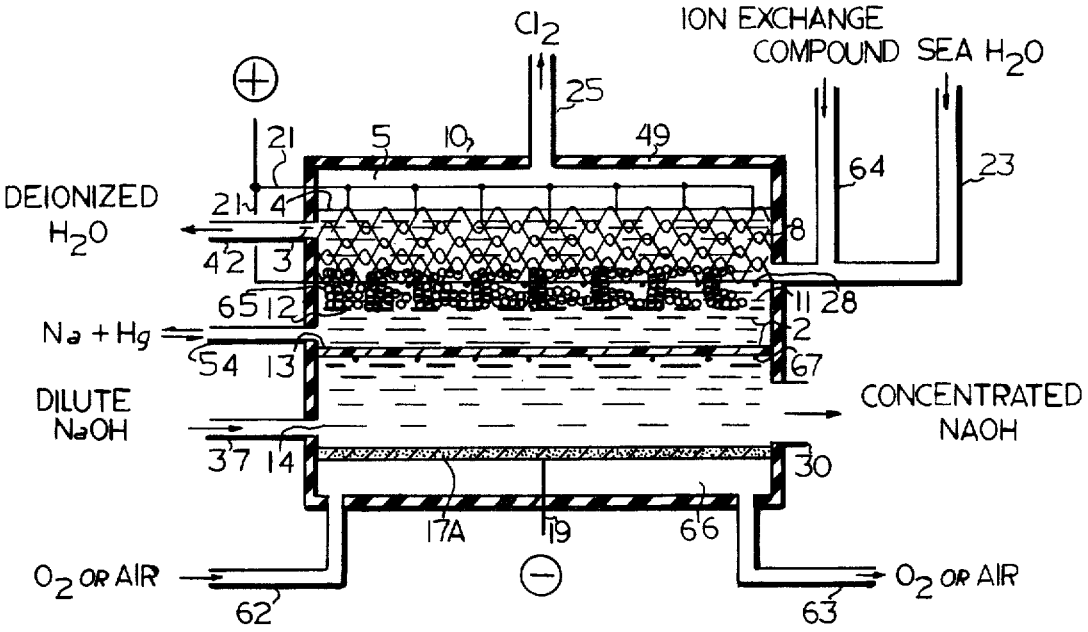
Figure 4:
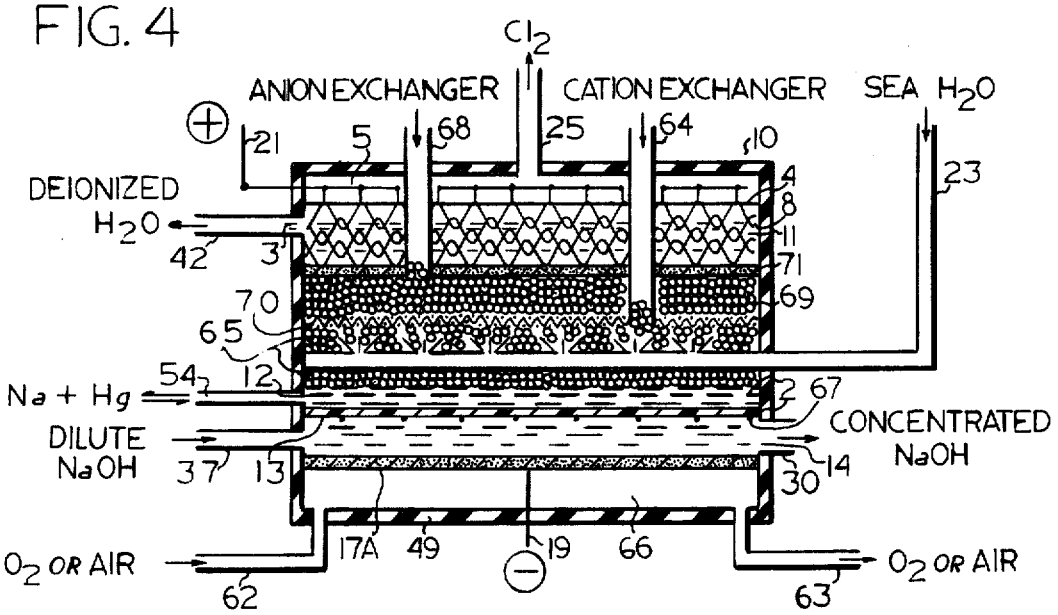
Figure 5:
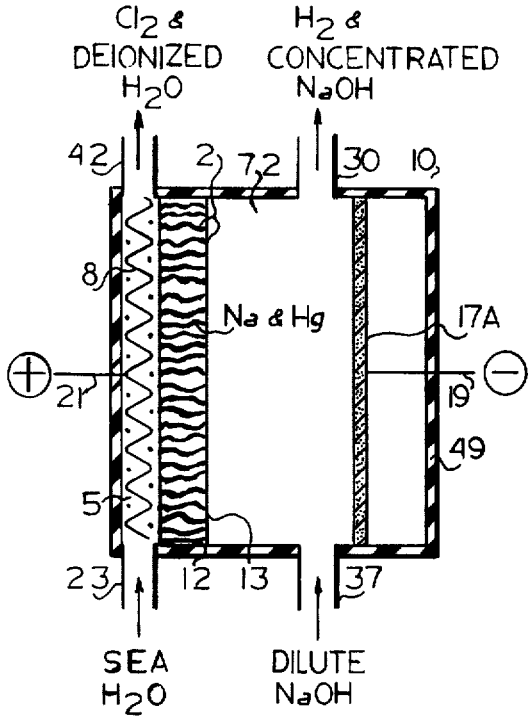
Figure 6:
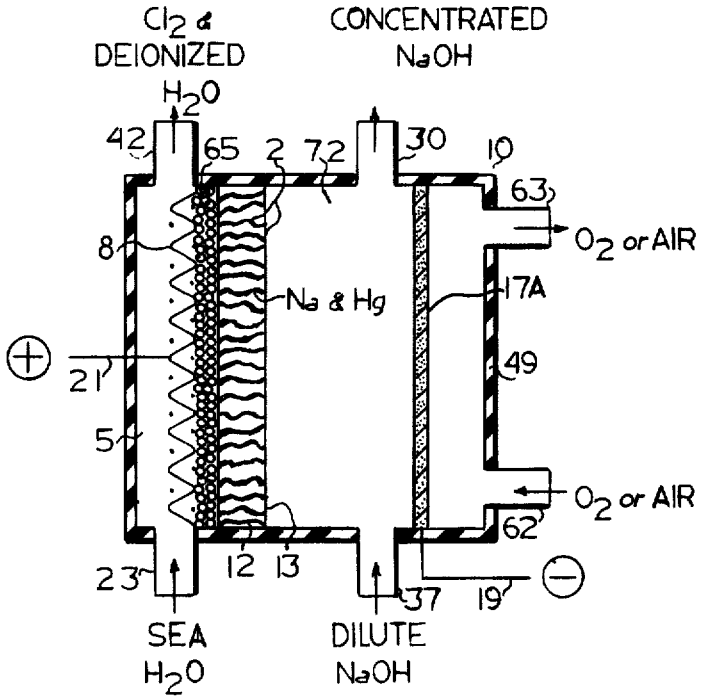

Of two variations of immobile liquid alkali metal amalgam structures of use in the present invention, the first variation is disclosed in FIGS. 1, 3, and 4; and the second variation is depicted in FIGS. 5, and 6. The first of the said novel variations is characterized by an immobile, continuous phase of liquid alkali metal mercury amalgam in a substantially horizontal plane, said amalgam being supported by a polymeric or microporous metal diaphragm. The said polymeric diaphragm is of the cationic permeable type and is itself supported by a suitable grid. Both the supporting diaphragms are in contact with caustic soda containing catholyte, and not exposed to aqueous chlorine. The second of said novel and improved variations is a diaphragm structure comprising immobile liquid alkali metal amalgam held within the connecting pores of a microporous inert solid. Characteristics of said microporous solid are described in connection with descriptions of FIGS. 5 and 6. A third variation, described in connection with descriptions of FIGS. 7 and 8, includes the diaphragm structure of the second variation and a novel type of electrosorption to still further reduce energy requirements.

A primary object of this invention is to provide a viable method for the simultaneous deionization of sea water and production of chlorine, caustic soda, and hydrogen. Other objects are conservation of energy by provision of a process and apparatus which, with the same energy expenditure, will produce both deionized water and chlorine, caustic soda, and hydrogen; provision of a method and apparatus which will produce deionized water from the sea at a cost to allow use of said water for agriculture, as well as for domestic and industrial purposes; provide an electrochemical process and apparatus which will consume energy in amounts competitive with energy used in present chlor-alkali production; and provide an apparatus which will resist the corrosive action of the fluids involved in electrochemical production of chlorine and caustic soda.

The accompanying FIG. 1, to which reference is now made, illustrates the invention, of which modifications are shown in FIGS. 2, and 3, 4, 5, and 6, and 7 and 8.

FIG. 1 represents an electrolytic cell 10 of this invention which comprises an anode compartment 5, a diaphragm structure 2, and a cathode compartment 18. The anode compartment 5 contains an anode 8 situated above diaphragm structure 2, and most of the space in which anode 2 is located is filled with anolyte 3 consisting of sea water. The space immediately below diaphragm structure 2 is filled with catholyte 14 consisting of caustic soda solution. Below solution 14 is a cathode 15, said cathode being covered, at its surface apposite solution 14, by a dielectric membrane 16. Also contained in anode compartment 5 are a sea water inlet 23 and outlet 42 for depleted sea water, an outlet for chlorine 25, an inlet 37 for catholyte 14, and an outlet for said catholyte, 30. Diaphragm structure 2 comprises cation permeable diaphragm 13 supporting an immobilized continuous phase of liquid sodium mercury amalgam 12; a pipe 54 allows for regulation of the depth of amalgam 12. Cathode compartment 18 contains cathode 17, catholyte inlet 30 and outlet 32, and an outlet 31 for hydrogen. It is preferred to provide a hydrogen degasser 22 for catholyte 14; degasser 22 contains an inlet 32 and an outlet 35 for said catholyte, a vent 33 for hydrogen, and a stirrer 57.

Anode 8 is constructed, preferably, of knitted wire mesh, the wire of which has, preferably, a core of copper or other good electrical conductor. Said core is encased in a corrosion resistant metal, preferably titanium, the titanium having a thin coating of a platinum group metal, preferably ruthenium, or oxides, alloys or compounds of ruthenium. Anode 8 may be suspended by a suitably stiffened plastic rod 4, made by encasing a steel rod with a plastic such as polypropylene, and the lower wires of mesh anode 8 may rest on a grid 28. Grid 28 is preferably constructed of dimensionally stable titanium wire coated with ruthenium oxide and electrically connected to a wire 21 so that grid 28 acts as an anode. Grid 28 and rod 4 may be suitably supported by walls of cell 10 (support not shown). A branch of wire 21 is also electrically connected to anode 8, and wire 21 connects with the positive pole of a source 20 of low voltage D.C. current. Wire 21 may be made with a copper core encased with titanium and insulated with a plastic where said wire goes thru the walls of cell 10.

Amalgam 12 is composed of mercury containing from about 0.1 to about 0.3 weight percent of a metal of the alkali family, preferably sodium. Supporting the horizontal layer of amalgam 12 is a diaphragm 13. Diaphragm 13 is preferably made of a microporous metal such as steel, but porous nickel, copper, stainless steel, or titanium may also be used. The pores of said porous metal diaphragm 13 may range in size from about 50 to about 200 microns, 100 microns being preferred; diaphragm 13 may be supported by, and insulated from, the walls of cell 10 by any suitable support, such as hard rubber ring 52. Diaphragm 13 may also be constructed of cation permeable organic polymers as polystyrene sulfonic acid, perfluoroethylene sulfonic acid polymer, or by a porous polypropylene or porous polytetrafluoroethylene. If organic polymers are used as diaphragm 13 suitable plastic grids or metallic grids are used to support said polymers, and said grids may be supported and insulated from the walls of cell 10 by suitable means. Divinylbenzene sulfonic acid polymers may be used as diaphragm 13.

Cathode 15 may be made of a steel plate; the function of cathode 15 is to attract the sodium ions from amalgam 13 into catholyte 14. To prevent electrical discharge of said ions by cathode 15 a dielectric membrane 16 covers all surfaces of cathode 15 which might otherwise be exposed to catholyte 14. Membrane 16 may be made of poly-tetrafluoroethylene, polypropylene, or other dielectric not attacked by caustic soda solution, and membrane 16 may be attached to plate 15 by a suitable cement, such as an epoxy resin, preferably at areas of plate 15 not conterminous with catholyte 14. Cathode 15 is supported by and insulated from walls of cell 10 by a suitable support, such as a ring 50 of polyvinylchloride. Cathode 15 is electrically joined to the negative pole of current source 20 by a conducting wire 19. Wire 19 is insulated from wall of cell 10.

The space 11, between the underside of grid 28 and the upper surface of amalgam 12, is filled with brine and is called the brine gap. It is preferred to restrict the depth of gap 11 to a range which would just prevent an electrical short between grid 28 and amalgam 12. One means for prevention of said short is a combination of sensor and computer sold by the Marstolin Group of Hamilton, Bermuda; dimensionally stable titanium anodes, such as grid 28, also may be obtained from said company. (Sensor and computer are not shown). Heat exchangers 59 and 60, for anolyte 3 and catholyte 14 respectively, may also be used in conjunction with said sensor and computer to regulate the depth of gap 11, which can be regulated to within a few thousandths of an inch provided that tht upper surface of amalgam 12 is kept calm. An important function of anode grid 28 and anode mesh 8 is to intimately contact said anolyte to reduce ionic travel distance without disturbing the surface of amalgam 12.

Wire as described for making anode 8 may be obtained from Astrometallurgical Co. of Wooster, Ohio and said wire may be knitted by York Wire Co. of Parsippany, New Jersey or by Metex Co. of Edison, New Jersey. The knitted mesh may be ruthenium coated by the Marstolin Group.

Cathode 17, in cathode compartment 18, is preferably made of steel knitted wire mesh suspended by a rod 9. Rod 9 may be constructed and supported in a manner similar to that of rod 4. Cathode 17 should not touch the walls of compartment 18; said cathode is electrically connected by conductor 19 to the negative pole of voltage source 20. If desired, cathode 17 may be made of metals such as stainless steel, nickel, titanium or other metals not affected by catholyte 14.

Degasser 22 functions to eliminate any residual gas in catholyte 14 so that during recycling of said catholyte thru cell 10, no gas would rise under porous plate 13. Principles for degassing of liquids are well known, and need not be elaborated herein.

To operate cell 10, sea water, suitably treated, is pumped via pipe 23 by pump 24 thru valve 47 and check valve 46 and thru heat exchanger 59 into cell 10. Chlorine ions in said sea water, herein called anolyte 3, are electrically discharged by anodes 28 and 8 to form chlorine gas, most of said gas being vented thru pipe 25. Sodium ions, attracted by cathode 15, travel thru brine gap 11. Anolyte 3 leaves cell 10 via pipe 42 aided by pump 29. If desalination of anolyte 3 has proceeded to a satisfactory degree, part of said anolyte is allowed to leave pipe 42 thru a valve 43 to be collected in a storage tank (not shown). The balance of anolyte is recycled to cell 10 via pipe 44, valve 51 and check valve 45, and heat exchanger 59. In exchanger 59 the recycled anolyte 3 raises the temperature of incoming sea water. The ratio of said recycled to fresh anolyte may be regulated by valves 51 and 47.

Sodium ions, having migrated thru brine gap 11, are transmitted thru amalgam 12 to catholyte 14 via the pores of plate 13. Catholyte 14 is pumped by a pump 36 thru chamber 5 and thru pipe 30 into cathode chamber 18 and said sodium ions are swept along with catholyte 14 to be discharged by cathode 17, to form sodium hydroxide and hydrogen. The latter is vented thru pipe 31, and the caustic soda solution is allowed to flow via a pipe 32 into degasser 22. Part of the gas-free catholyte, if of the desired sodium hydroxide concentration, is allowed to flow thru pipe 35 and valve 34 to storage (storage tank not shown). The balance of catholyte 14 is pumped by a pump 53 via a pipe 37, valve 26, check valve 27, and heat exchanger 60 to pump 36 whereby, as related above, catholyte 14 is recycled to cell 10. An amount of dilute caustic soda solution, equal to that passed by valve 34 to storage, is pumped by a pump 39 via a pipe 38 thru a valve 41 and check valve 40 and thru heat exchanger 60, wherein the temperature of said dilute caustic soda solution is raised by recycled catholyte 14; said dilute caustic solution is then pumped by pump 36 via pipe 37 into cell 10, mingled with recycled catholyte 14 as stated. The concentration of sodium hydroxide in the said dilute caustic solution is such as will result in a concentration of about 50 percent of sodium hydroxide in catholyte leaving cathode chamber 18.

The walls 48 of cell 10 may be made of steel lined with rubber 49 at all surfaces of steel wall 48 which might otherwise be in contact with chlorine containing anolyte 3. Walls of catholyte chamber 18 and of degasser 22 may also be made of steel. Piping, pumps, valves, and heat exchanger coming in contact with caustic soda solution may be constructed of steel. Piping coming in contact with sea water and anolyte 3 may be made of a suitable plastic such as polyvinylchloride. Piping inside heat exchanger 59 may be made of copper-nickel alloy, said alloy may also be used for walls of exchanger 59, and for pumps and valves for service with sea water and recycled anolyte 3. To electrically insulate catholyte 14 in cell 10, pump 36 is preferably a positive displacement, completely rubber lined pump, such as the Moyno valveless, screw-type pump. Pipes 37 and 30 are preferably made of rubber, and, as shown in FIG. 1, walls contacting catholyte 14 are constructed of electrically insulating material, such as hard rubber. The steel walls of catholyte chamber 18 should be rubber lined. Pipe 54 and a valve 55 for regulating the volume of amalgam 12 may be made of rubber.

Pumps and valves used in FIG. 1 may be operated electrically or by other suitable means.

To aid in maintaining a calm top surface of amalgam 12 cell 10 is preferably mounted on rubber mounts (mounts not shown). To decrease surface tension of anolyte 3, thus aiding escape of chlorine gas, it is preferred to add very small amounts of wetting agents to said anolyte, as described in Canadian Pat. No. 465365 and in West German Pat. No. 1022194.

Where meshes of anode 8 and cathode 17 protrude above liquid level in cell 10 and chamber 18 respectively, said meshes act to demist gas leaving the respective said anode cell 10 and cathode chamber 18.

Although the apparatus of FIG. 1 will function in accordance with objects herein stated, it is preferred to decrease energy requirements particularly as conductance of sea water decreases with continuous depletion of said water of its solutes. Accordingly, it is preferred to employ supporting electrolytes to facilitates the conduction of cations. Examples of said supporting electrolytes are cationic exchange resins in granule form. Suitable as said cationic exchange resins are resins of the "Amberlite" type, in particular Amberlite 200 which is a copolymer of divinyl benzene and styrene containing sulfonic acid groups. Other suitable resins are the perfluoroaliphatic sulfonic acid polymers disclosed in U.S. Pat. Nos. 3,041,317, 3,282,875, and 3,718,627. Among still other cation exchange resins chemically resistant to dilute aqueous chlorine, and not wettable by mercury, are polystyrene sulfonic acid, polyvinyl chloride sulfonic acid, and copolymers of vinyl chloride with vinyl esters of lower aliphatic acids containing sulfonic acid groups. Mesh sizes of cationic exchangers are usually between about 16 and 50 mesh, and said sizes are suitable for use herein; said sizes are measured by United States standard sieve sizes.

Said cation exchange resins 65 are placed in cell 10, resting on the upper surface of amalgam 12, and extending upward to at least the discharging surfaces of anodes 8 and 28. In the interest of clarity, the numbers of granules 65 are shown only partially in cell 10 of FIG. 1. Granules 65 may be introduced into cell 10 as a water suspension via a pipe 64 which is a branch of pipe 23. Since ionic conduction, under the influence of an electric field, by way of ion exchange granules, is partly dependent on maintaining firm contact among said granules, it is preferred to design the mesh of anode 8 so as to enable said anode to act as a retaining screen for said granules, and to design the spacing of elements of grid 28 so as to allow free flow of said granules thru said grid.

Most organic ion exchangers are of a density lower than that of water and thus tend to pass upward thru grid 28. Since firm contact among granules 65 is desired, it is preferred to enter granules 65 in a state not fully expanded by water, so that subsequent swelling of said granules will ensure good contact among granules 65 from the surface of amalgam 12 to discharging surfaces of anodes 8 and 28.

The use of cationic exchangers decreases the importance of the depth of brine gap 11. Since the travel distance of anions is greatly decreased by the very large surface of anode 8 and the turbulent nature of the flow of anolyte 3 thru said anode, and since the conductivity of sodium ions is largely unimpaired, regardless of the concentration of said ions in anolyte 3, due to the use of ion exchangers, the energy requirements for attaining the objects of the present invention are kept within desired limits. The function of supporting electrolytes, in the form of cation exchange resins is to accept sodium ions from anolyte 3, and, under the influence of the electric field present in cell 10, to pass on the said sodium ions to amalgam 12.

In addition to the organic cation exchangers 65 mentioned, inorganic cation exchangers may also be suitably used; for example the sodium titanates of the formulae $NaTi_2O_5H$ and $Na_2Ti_3O_7$ are of use as cation exchangers herein because of their resistance to degradation by the fluids of cell 10.

FIG. 2 respresents an oxygen depolarized cathode of the invention. Cathode compartment 18A contains porous cathode 17A and an inlet 62 and an outlet 63 for oxygen or air which converts the discharged hydrogen to water, reducing cell voltage of the operating cell and results in lower power requirements per ton of product. Cathode 17A is a microporous catalyzed body formed of suitable materials such as microporous graphite on which is distributed a catalytic metal, or a porous corrosion-resistant metal such as, for example nickel, titanium, tantalum and the like. Walls and all pipes leading into and out of compartment 18A are preferably made of hard rubber or other non-conductor of electric current.

FIG. 3 represents a modification of the cell 10 of FIG. 1 wherein the amalgam component of diaphragm structure 2 is supported on a cationic permeable membrane 13 which is formed of a sulfonic acid polymer as previously described, instead of the porous metal support 13 of FIG. 1. Membrane 13 is in turn supported by a grid 67, which is preferably made of a polymer such as polypropylene, polytetrafluoroethylene or the like. Since cathode 17A of FIG. 3 is a discharging surface for sodium ions, catholyte exit pipe 30 leads directly to degasser 22, from cathode compartment 66. Because the amalgam 12 supporting diaphragm 13 of FIG. 3 has a solid surface as contrasted to the porous nature of supporting diaphragm 13 of FIG. 1, it is possible to arrange to position the cation discharging cathode 17A under said diaphragm 13 of FIG. 3. Said arrangement is inadvisable in FIG. 1 since liberated gas would plug the pores of the porous diaphragm 13 of FIG. 1.

Operation of cell 10 of FIG. 3 is no different from that described in connection with FIGS. 1, and 2.

The cell 10 of FIG. 4, now referred to, is modified from the cell 10 of FIG. 3 in several ways as follows. A supporting anionic resin 69, used in cell 10 of FIG. 4, is separated from cationic exchange resin 65 by a screen 70. Anion exchange resin 69 may suitably be of the quaternary ammonium salt polymer type, for example a co-polymer of styrene and divinylbenzene with quaternary ammonium groups, and screen 70 may suitably be made of titanium wire mesh. An inlet pipe 68 is provided for introduction of resin 69 into cell 10. To protect resin 69 from the corrosive action of aqueous chlorine a porous plate 71 allows sea water from pipe 23 to flow upward, thus preventing liberated chlorine solution from diffusing downward into resin 69. Porous plate 71 may be suitably constructed of porous polypropylene or porous polytetrafluoroethylene or the like. For better distribution of sea water, pipe 23 was extended thru cell 10, and openings were made at intervals in said pipe. Under influence of the electric field, chlorine ions are conducted toward anode 8, and sodium ions are conducted toward cathode 17A by anionic exchanger 69 and cationic exchanger 65 respectively. Cation permeable diaphragm 2 of FIGS. 3 and 4 are identical, and operation of cell 10 of FIG. 4 is the same as that described for cell 10 of FIG. 3.

The cells 10 of FIGS. 5 and 6, now referred to, depict the second of the two variations of the immobile liquid alkali metal amalgam structures above referred to. Said structure 2 variation, as noted, comprises a microporous inert solid 13, the pores of which are interconnected. Said pores contain the liquid alkali metal amalgam 12 and said amalgam serves to conduct cations from anode compartment 5 to cathode compartment 72. Cation permeable structure 2 may be used in either the vertical position, as in FIGS. 5 and 6 or in a horizontal position (not shown). The porous body 13 may be formed of suitable materials not readily affected by the fluids of cell 10. For example porous graphite, porous glass, called sintered glass, or porous metals such as titanium or tantalum or the like may be used to construct body 13; porous titanium is the preferred material of construction; and the pore sizes, while said sizes may vary thru a considerable range, are preferred to be in the range of 50 to 100 microns. The pores of body 13 may be filled with amalgam 12 by immersing body 13 in amalgam 12 in a suitable vessel and applying air or gas pressure at right angle to the plane of the surface of body 13 while allowing amalgam 12 to be displaced in the direction in which said pressure is applied. A gasket should, of course, be used to avoid any clearance between body 13 and the said vessel to prevent amalgam 12 from by-passing body 13. Filling of the pores of 13 by amalgam 12 is preferably done at the maximum operating temperature to be used in the operation of cell 10. To minimize electrical resistance, it is preferred to restrict the thickness of porous body 13 to the range of about one millimeter, to restrict the brine gap to about 0.001 inches, and to select a mesh size for the supporting electrolyte 65 of FIG. 6 below 50 microns so that said electrolyte will be in contact with amalgam 12 if a slight contraction of said amalgam takes place due to a reduced temperature during operation of cell 10. The anode 8 of FIG. 6 should preferably be of woven screen type with a mesh size smaller than 50 microns to enable said anode to hold electrolyte 65 pressed against porous body 13. Electrolyte 65 will thus fill said brine gap of FIG. 6.

In accordance with this invention, in the operation of the cells 10 of FIGS. 5 and 6, sea water is fed into the anode compartment 5 thru inlet 23. Anode 8 and cathode 17A are supplied with electric current at a suitable potential. Salt in said sea water is electrolyzed in compartment 5 forming chlorine gas which is removed with the deionized water thru outlet 42. Alkali metal ions pass thru supporting electrolyte 65 and amalgam 12 in the case of FIG. 6, and in the case of FIG. 5 said alkali metal ions pass thru amalgam 12. Alkali metal ion transfer is caused by the voltage gradient. Said impressed voltage is preferably in the range of 3.5 to 4.5 volts. At cathode 17A, alkali metal ions are discharged to form concentrated alkali metal hydroxide formed by reaction of alkali metal atoms with water in the dilute caustic soda solution fed into cell 10 at inlet 37, during which reaction hydrogen is also formed. In the case of cell 10 of FIG. 6 said hydrogen reacts with oxygen to reform water, and concentrated caustic solution is led from said cell 10 thru outlet 30. Oxygen is supplied to cell 10 thru inlet 62 and excess oxygen removed thru outlet 63. In the case of cell 10 of FIG. 5, hydrogen and concentrated caustic solution are removed thru outlet 30.

Altho all the cells 10 disclosed herein function to produce deionized water, chlorine, concentrated caustic solution and hydrogen, most favorable results were obtained with the cells 10 of FIGS. 5 and 6, and in particular with cell 10 of FIG. 6 when sodium titanate was used as supporting electrolyte 65. Said sodium titanate has the formula $NaTi_2O_5H$.

If desired, recirculation of anolytes and catholytes discharged from the cells 10 in the Figures herein depicted may be carried out in accordance with said recirculation depicted in FIG. 1. The gas lift effect of chlorine in said anolytes and hydrogen in said catholyts will reduce energy required for said recirculation.

Altho electrolysis of sea water is the primary aim of this invention, brines containing greater or lesser concentrations of solutes than the 35,000 ppm contained in sea water may be electrolyzed in the disclosed apparatus for production of deionized water and chlor-alkali products, including chlorine and bromine.

If desired, sea water deionization may be limited to a solute concentration of about 5000 ppm, with the resultant water further treated by electrodialysis to produce the desired degree of deionization.

If desired, instead of a feed of dilute caustic soda solution to inlet of the cells 10, water may be so fed.

It has been found that overall power consumption per unit of product is reduced by maintaining turbulent flow of sea water thru the anolyte compartments 5 of the cells 10 herein depicted.

Objects of the present invention as regards limited power requirements are attained by factors mentioned in the above specification and also by eliminating the need for cation permeable membranes to contain the liquid amalgam 12 in FIGS. 5 and 6, and in limiting the need to one cation permeable membrane or diaphragm to contain liquid amalgam 12 in FIGS. 1, 3 and 4. However, in view of the highly competitive nature of the chlor-alkali industry, wherein a chief cost factor is power required per unit of production, further reduction of said power requirements is highly desirable. Hence a third variation, above mentioned, is concerned with reduction of power required.

Figure 7:
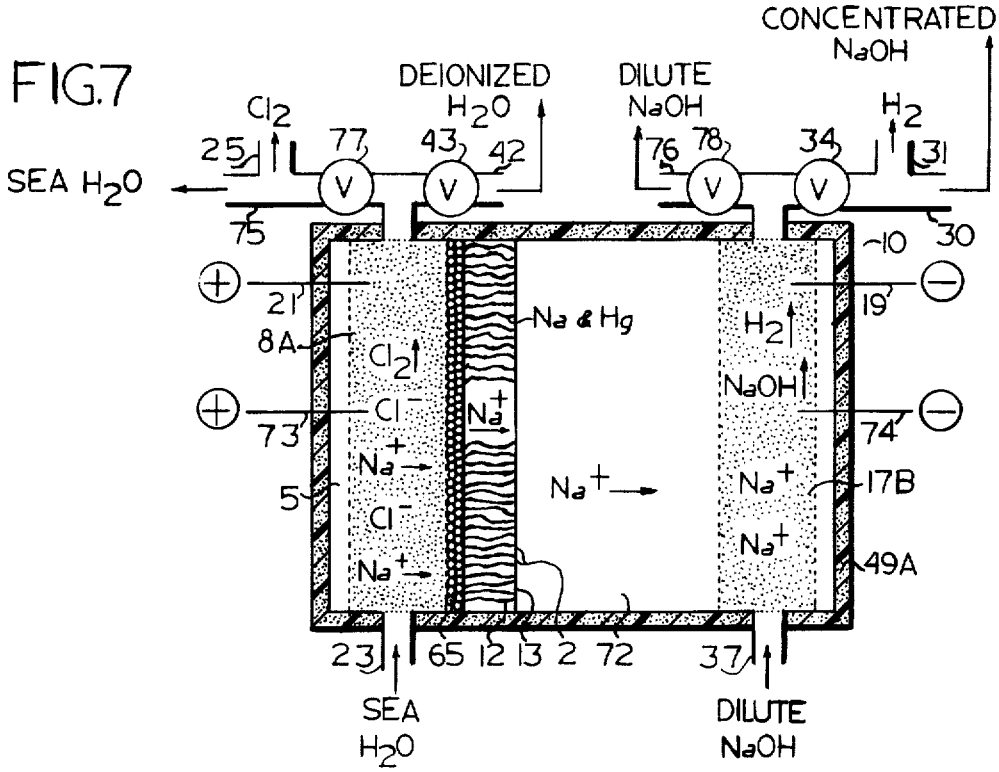

Since the chief reason for high power requirements of the cells described herein lies in the steadily decreasing ionic concentration of the anolyte as electrolysis proceeds, to counter the said ionic depletion, a novel form of electrosorption with porous electrodes is employed in said third variation. In the usual form of electrosorption, using a potential lower than the discharging potential for the ions concerned, when the electrodes, used as capacitors, are saturated, polarity of said electrodes is reversed allowing the stored ions to recombine. In the present novel form of electrosorption, the anodic electrode 8A, FIG. 7, is separated by the amalgam structure 2, from the cathodic electrode, 17B. After said electrodes are substantially saturated by anions and cations respectively, voltage of the said electrodes is raised to or above the discharging voltage for the stored ions. Said ions are thereby electrically discharged. Power requirements are substantially reduced because of three factors:

1. Becaue the anolyte is contained in the pores of the flow-thru anode 8A, distance of anions to anode is greatly reduced.

2. Voltage, and hence power required, is substantially reduced during the sorption cycle compared with the constant voltage of commercial electrolytic cells.

3. During the discharge of ions collected on the anode 8A, and cathode 17B of cell 10 power requirements are relatively low because of the reduced time during which discharge voltage is in use.

Referring to FIG. 7, the electrolytic cell 10 is provided with containing walls 49A which are preferably made of an electric and thermal insulating material, for example a urethane foam plastic. Said plastic may be reinforced at its external surface by a metal. (Reinforcement not shown). Cell 10 contains the anode 8A which is a porous electrical conductor made, for example of porous graphite or granular commercial charcoal or granular titanium which has been sintered and then coated with a metal of the platinum family, for example ruthenium. If granular charcoal is thus used said granules may be lightly compressed into a cage made of titanium screen (cage not shown). The anode 8A is preferably made in the form of a rectangular parallelepiped with the dimension, indicated by the arrow showing direction of travel of sodium ions, preferably of the order of about 2 millimeters (mm). A space, preferably of the order of about 0.001 inches, between anode 8A and diaphragm structure 2 is filled, preferably, with a supporting electrolyte 65, previously discussed. The dimension of structure 2, indicated by the arrow showing direction of travel of sodium ions, is preferably of the order of about 1.5 mm. Finally, cell 10 contains a cathode 17B which may be constructed of materials and in a manner similar to that described in connection with anode 8A. The anode 8A is provided with two electric current conductors 21, and 73; and cathode 17B is similarly provided with conductors 19 and 74. Said conductors may be made of copper wire coated with titanium.

Operation of cell 10 of FIG. 7 is preferably carried out at a constant temperature of the order of about 97° or 98° C., for the reason that, at constant temperature expansion and contraction of amalgam 12 is avoided, and also that description of chlorine is aided by the high temperature mentioned. Also electrical conductivity is enhanced at the temperature mentioned. In the sorption cycle sea water at about 98° C. enters cell 10 thru pipe 23, and is pumped (pumps not shown) thru anode 8A which is charged to a potential between 8A and 17B, of a voltage of about 1.0 to about 1.8 volts, thru conductors 73 and 74. Chlorine ions will adhere to the pore surfaces of said anode, sodium ions aided, by supporting electrolyte 65, will be conducted by amalgam 12 into cathode chamber 72 from the anode chamber 5. Dilute caustic soda solution also at a temperature of about 98° C. is pumped thru pipe 37 to flow upward thru cathode 17B. Sodium ions adhere to the pore surfaces of said cathode. With valve 77 closed and valve 43 open deionized water will flow out of cell 10 thru pipe 42; and with valve 34 closed and valve 78 open dilute caustic soda will leave cell 10 via pipe 76. When electrode 8A approaches saturation with respect to chlorine ions, which may be monitored by analysis of said deionized water, valves 43 and 78 are closed, the potential between electrodes 8A and 17B is raised to a discharging voltage of between about 3 and about 4 volts by way of conductors 21 and 19 respectively, valves 77 and 34 are opened, and chlorine gas, displaced by upflowing sea water, will exit from cell 10 via pipe 25, and sea water will leave cell 10 thru pipe 75. Dilute caustic soda solution, entering cell 10 will be enriched by NaOH formed in cathode 17B, and mixed with hydrogen, will leave cell 10, the hydrogen via pipe 31, and the concentrated caustic soda solution via pipe 30. To conserve energy, insulated reservoirs may be used to store sea water and dilute caustic soda solution before recirculation of the respective liquids to pipes 23 and 37 respectively of the cell 10. Said deionized water and concentrated NaOH may be run thru heat exchangers to preheat fresh sea water replacement. (Pumps, reservoirs, and heat exchangers not shown).

After substantially all chlorine, hydrogen, and concentrated NaOH have been displaced from cell 10, potential between anode 8A and cathode 17B is reduced to the former 1.0 to about 1.8 volts and the sorption and desorption cycles may be repeated.

If it is desired to further desalt the deionized water effluent from cell 10, said water may be treated, preferably in a second cell similar to said cell 10, by substituting said water for sea water. During the sorption cycle, further desalted deionized water will be effluent from said second cell, and during the desorption cycle chlorine and the deionized water effluent from cell 10 will emerge from the said second cell. The concentrated NaOH may be further concentrated by retreating said NaOH, preferably in the said second cell, in a manner similar to retreatment of deionized water.

Figure 8:
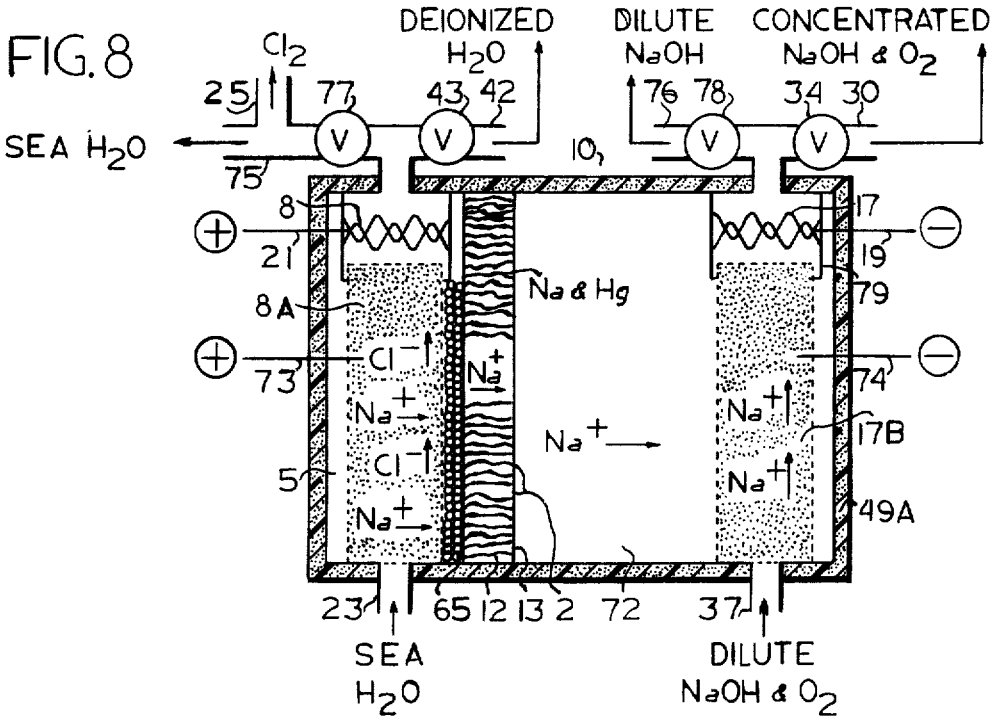

Referring to cell 10 of FIG. 8, a replacement for part of anode 8A has been made, using anode 8 as said replacement. Similarly, cathode 17 has replaced part of cathode 17B. Both replacement electrodes are encased, individually, in rubber sleeves 79, said sleeves fitting, in water tight fashion over the electrodes, individually, of cell 10 of FIG. 8. Electric conductor 21 is now attached to anode 8, and conductor 19 is attached to cathode 17. Otherwise, contents of the cells 10 of FIGS. 7 and 8 are identical.

In operation of cell 10 of FIG. 8, during the sorption cycle, using potential differences as given for FIG. 7, chlorine ions adhere to anode 8A and sodium ions travel to and are affixed to cathode 17B. When near saturation of the respective electrodes has been reached, polarity of anode 8A and cathode 17B is reversed to a potential about equal to the voltage difference before reversal, and a discharging potential, equal to the discharging voltage mentioned with respect to cell 10 of FIG. 7, is established in anode 8 and cathode 17. Chlorine ions repelled by electrode 8A now are attracted to anode 8 and are then discharged, and sodium ions repelled by electrode 17B now are attracted to cathode 17 and are then discharged. To reduce power requirements, oxygen is mixed with entering dilute caustic soda solution to oxidize hydrogen generated at cathode 17. Hence no hydrogen is emitted with the concentrated NaOH from cell 10 of FIG. 8. Excess oxygen, emitted with said concentrated caustic solution, may be recycled. Cathode 17 is preferably coated with a hydrogen oxidation catalyst such as ruthenium or reduced nickel. With the operational details already described, complete operation of cell 10 of FIG. 8 follows closely the operation of cell 10 of FIG. 7 above described.

Although the cells 10 of FIGS. 7 and 8 show porous electrodes separated by a diaphragm structure containing an immobilized liquid alkali metal amalgam, the novel electrosorption process therein illustrated may be practiced with said porous electrodes separated by diaphragms used in electrolytic cells, such as for example, asbestos diaphragms, or diaphragms of perfluoroaliphatic polymers containing sulfonic acid groups.

The valves of FIGS. 7 and 8 may be operated manually or in any other suitable manner.

The novel electrosorption process may, if desired, also be practiced with the diaphragm structure as disclosed in FIGS. 3 and 4.

Variations, for example, multiple porous electrodes arranged in stacks, may be used without departing from the scope of the present invention.

What is claimed is:

1. A novel process for the production of deionized water, alkali metal hydroxide, halogen, and hydrogen from an anolyte comprising an aqueous saline solution the solutes of which comprise alkali metal halides, said halides being selected from the group consisting of chloride and bromide, said anolyte being continuously influent to the anodic compartment of an electrolytic cell, said process being characterized by two alternating phases, a first of said phases comprising the electrosorption of anions in said anolyte on the surface of a porous anode immersed in said anolyte, said anode being impressed with a voltage lower than the discharge D.C. voltage for said anions, said voltage activating transmission of cations in said anolyte from said anodic compartment thru a cation-permeable diaphragm structure separating said anodic compartment from a cathodic compartment of said cell, said cations being then transmitted by said impressed voltage thru a catholyte comprised of an aqueous alkali metal hydroxide solution continuously circulated thru said cathodic compartment, said anolyte and said catholyte being separately maintained, said cations being then electrosorbed on the surface of a porous cathode immersed in said catholyte, said cathode being impressed by a lower than discharge D.C. voltage for said cations, the so formed at least partly deionized water being effluent from said anodic compartment during said first phase of said process, and a second of said alternating phases comprising the raising of the D.C. voltage of both said anode and said cathode to or above the voltage necessary for electrical discharge of the said electrosorbed anions and cations respectively, the so formed halogen being effluent with said anolyte and the so formed alkali metal hydroxide and hydrogen being effluent with said catholyte during said second phase, and finally the voltage of both said anode and said cathode being lowered as specified above for said first phase as part of an alternation to said first phase of said novel process.

2. The processes of claim 1, wherein the said cation-permeable diaphragm structure is comprised of a liquid, immobilized, alkali metal amalgam contained in and supported by the pores of a porous substantially self-supporting solid, at least one surface of said amalgam being unenclosed by said pores.

3. The process of claim 2, wherein the alkali metal of said liquid, immobilized alkali metal amalgam is sodium.

4. The process of claim 2, wherein said porous solid is porous fritted glass.

5. The process of claim 1, wherein said anolyte is sea water.

6. The process of claim 1, wherein the alkali metal of said alkali metal halides is sodium.

7. The process of claim 1, wherein the said formed halogen is chlorine.

8. The processes of claim 1, wherein the said formed halogen is bromine.

9. The process of claim 1, wherein the said anodes, said cathodes, and said cation-permeable diaphragm structure are disposed in substantially vertical planes.

10. The process of claim 1, wherein said cation-permeable structure consists of asbestos fibers.

11. The process of claim 1, wherein the said cation-permeable structure consists of a perfluoroaliphatic sulfonic acid polymer.

12. The process of claim 1, wherein the said formed hydrogen is subjected to oxidation as said hydrogen is formed.

13. The process of claim 1 wherein said porous anode consists of porous graphite.

14. The process of claim 1, wherein the said porous anode consists of porous titanium coated with a metal of the platinum family.

15. The processes of claim 1, wherein the alkali metal hydroxide comprising said catholyte is sodium hydroxide.

16. The processes of claim 1, wherein the said formed alkali metal hydroxide is sodium hydroxide.

17. The processes of claim 1, wherein the said anolyte is an aqueous saline solution with a concentration of alkali metal halides greater than the concentration of alkali metal halides occurring in sea water.

* * * * *